US005176616A

United States Patent [19]

Schlip et al.

[11] Patent Number: 5,176,616

[45] Date of Patent: Jan. 5, 1993

[54] METHOD AND APPARATUS FOR THE AFTER-TREATMENT OF THE THICK MATERIAL IN THE THICK MATERIAL DISCHARGE REGION OF A SOLID BOWL WORM CENTRIFUGE

[75] Inventors: Reinhold Schlip, Woerthsee; Wolfgang Epper, Bergheim, both of Fed. Rep. of Germany

[73] Assignee: Kloeckner-Humboldt-Deutz Aktiengesellschaft, Fed. Rep. of Germany

[21] Appl. No.: 839,049

[22] Filed: Feb. 18, 1992

Related U.S. Application Data

[63] Continuation-in-part of Ser. No. 546,237, Jun. 29, 1990, abandoned.

[30] Foreign Application Priority Data

Jun. 29, 1989 [DE] Fed. Rep. of Germany ..... 3921328

[51] Int. Cl.[5] ..... B04B 3/04

[52] U.S. Cl. ..... 494/037; 494/25; 494/26; 494/53

[58] Field of Search ..... 494/22, 23, 25-30, 494/37, 42, 44, 48, 52-56, 66; 210/209, 512.1, 784, 788, 374; 366/167-169, 172, 173

[56] References Cited

U.S. PATENT DOCUMENTS

| | | | |
|---|---|---|---|
| 775,320 | 11/1904 | Van Kirk | 494/53 X |
| 2,283,457 | 5/1942 | Pecker | 210/374 |
| 2,612,314 | 9/1952 | Huelsdonk | 494/53 X |
| 3,200,068 | 8/1965 | Jonakin et al. | 494/27 X |
| 3,228,594 | 1/1966 | Amero | 494/23 |
| 3,279,687 | 10/1966 | Amero | 494/53 X |
| 3,279,688 | 10/1966 | Cook | 494/53 X |
| 3,302,873 | 2/1967 | Kowata | 494/27 |
| 3,348,767 | 10/1967 | Ferney | 494/53 X |
| 3,423,015 | 1/1969 | O'Conor | 494/27 |
| 3,471,081 | 10/1969 | O'Conor | 494/27 |
| 3,532,264 | 10/1970 | Amero | 494/53 X |
| 3,795,361 | 3/1974 | Lee | 494/26 |
| 3,885,734 | 5/1975 | Lee | 494/25 |
| 3,960,318 | 6/1976 | Dahlberg | 494/27 |
| 3,967,778 | 7/1976 | Hunwick | 494/29 |
| 3,971,509 | 7/1976 | Johnsen | 494/27 |
| 4,190,194 | 2/1980 | Amero | 494/53 X |
| 4,299,352 | 11/1981 | Erickson | 494/27 |
| 4,381,849 | 5/1983 | Conant | 494/53 |
| 4,496,340 | 1/1985 | Redeker et al. | 494/29 |
| 4,654,022 | 3/1987 | Shapiro | 494/29 |
| 4,790,806 | 12/1988 | High | 494/56 X |

FOREIGN PATENT DOCUMENTS

| | | | |
|---|---|---|---|
| 1021297 | 12/1957 | Fed. Rep. of Germany | 494/27 |
| 1026692 | 3/1958 | Fed. Rep. of Germany | 494/27 |
| 1025079 | 4/1966 | United Kingdom | 494/27 |

*Primary Examiner*—Harvey C. Hornsby
*Assistant Examiner*—Charles Cooley
*Attorney, Agent, or Firm*—Hill, Van Santen, Steadman & Simpson

[57] ABSTRACT

A centrifugal solid bowl worm separator having an outer cylindrical drum and an inner rotatable worm with helical flights on the outer surface with the drum arranged to receive a material to be separated in light and heavy fractions or phases and the mechanism provides for a method of injecting and mixing a fluidizing substance into the heavy fraction material within the drum before it leaves the drum to mix with the heavy fraction within the drum. The fluidizing substance lowers the density of the heavy fraction to enable its discharge by the worm flights. The hydraulic pressure of the liquid helps push the heavy fraction out of the separator which prevents a reverse flow and intermixing of the heavy fraction with the liquid fraction.

8 Claims, 1 Drawing Sheet

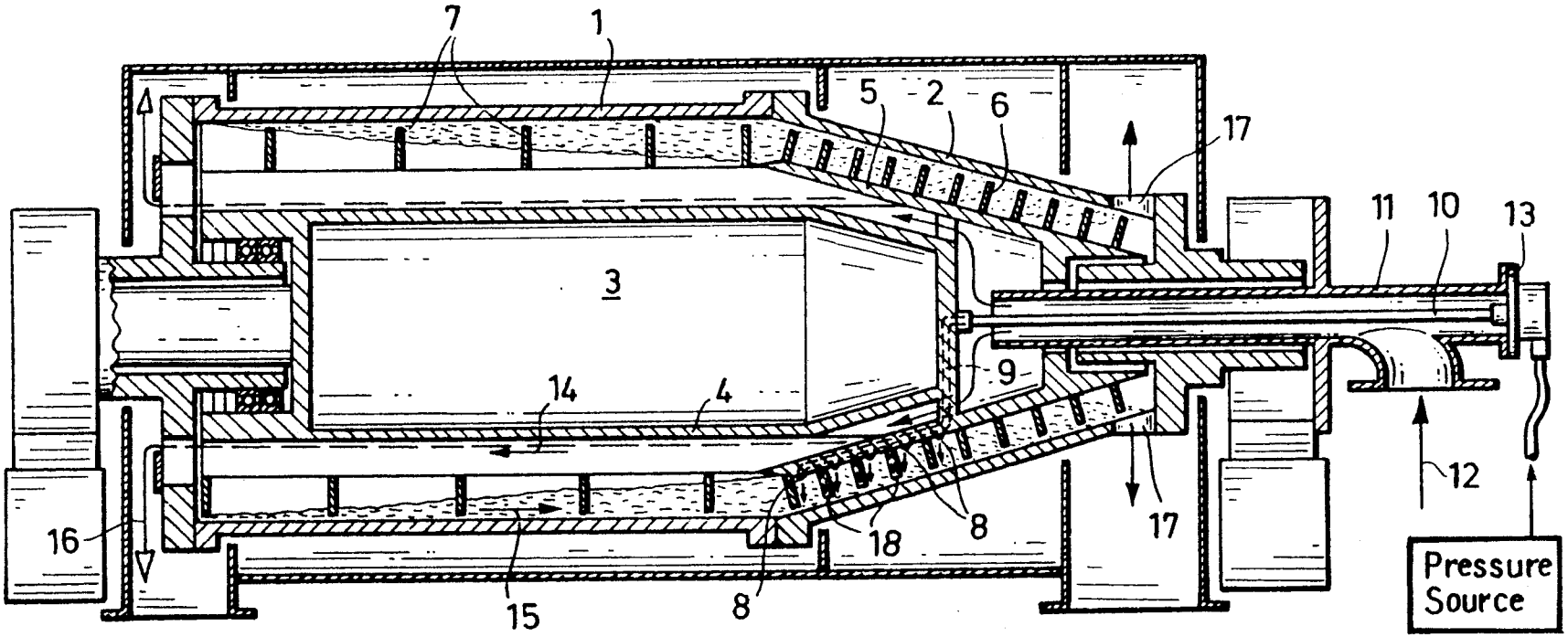
Pressure Source
13
10
11
12
17
17
6
2
5
9
8
18
8
4
3
1
14
15
7
16

METHOD AND APPARATUS FOR THE AFTER-TREATMENT OF THE THICK MATERIAL IN THE THICK MATERIAL DISCHARGE REGION OF A SOLID BOWL WORM CENTRIFUGE

This is a continuation-in-part of application Ser. No. 546,237, filed June 29, 1990 now abandoned.

BACKGROUND OF THE INVENTION

The invention is directed to improvements in a method and apparatus for the separation of materials into a thin or light phase and a thick or heavy phase, and more particularly to an arrangement for effecting and facilitating the discharge of the thick phase and mixing the thick phase with a fluidizing gas before it leaves the drum.

In previous methods of separation with a solid bowl worm centrifuge, the thick or heavy phase material is separated from the liquid or light phase in the operation and both phases are discharged from the drum through separate outlets. In the separation of certain materials such as those which are permeated with a solvent containing material, the solvent material may have the characteristic of being noxious and reeking, requiring that it be subjected to an appropriate after-treatment in a special unit as the heavy phase leaves the separator. This is necessary so that the heavy phase can be satisfactorily handled and subsequently safely stored or further processed.

Further, the discharge of thick material from a solid bowl worm centrifuge frequently presents difficulties particularly when the thick material has a relatively low viscosity. What occurs is that it is not appropriately seized by the worm conveyor helix in the conical jacket part of the centrifuge drum and therefore is not discharged to the outside but instead flows back between the worm helix and the inside wall of the conical drum into the separating space. In this space, the phases are already separated from one another and are again remixed so that the separating action of the separator is adversely affected.

An object of the invention is to provide an improved solid bowl separator and particularly one which can more satisfactorily handle heavy phase material of low viscosity or of varying viscosities.

A further object of the invention is to provide a solid bowl worm separator wherein the heavy phase material can be treated with a fluidizing gas while within the solid bowl separator so that admixing between the substance and heavy phase occurs within the separator and the material flowing form the separator is of a more appropriate nature for further handling and treatment.

A still further object of the invention is to provide an improved method and apparatus whereby particularly undesirable heavy phase fractions of material which are discharged form the separator are first treated by being admixed with gas within the separator at a location where the heavy fraction no longer has the opportunity to mix with the lighter fraction.

A still further object of the invention is to provide an improved method and apparatus involving use of a solid bowl worm separator wherein the separated heavy phase is admixed with a fluidizing gas before leaving in such a manner that the separating function of the separator is not adversely affected by undesirable heavy phase materials and whereby the heavy phase material is discharged in such a condition that it continues to flow freely and easily from the separator.

FEATURES OF THE INVENTION

In the practice of the invention, a fluidizing gas is introduced, such as under pressure, into the thick phase of material in the discharge region of a centrifuge. A substantial dispersion of the thick material is accomplished by the introduction of the fluidizing gas into the thick material so that even thick material which is difficult or impossible to convey is reliably handled and transported by the worm helixes of the conveyor worm so that the thick phase can be easily transported outside of the drum.

In accordance with the principles of the invention, in a treatment of the thick material by the introduction or admixing with a separate gas, the nature of the thick phase can be altered before discharge. The alteration may take the form of neutralization of the heavy phase, deodorization or other modifications of the nature of the heavy can be simultaneously accomplished. Compared to known methods, not only is the discharge of thick materials that are difficult to convey considerably facilitated, but no additional units for after-treatment of the thick sludge, which may be permeated with solvents and other injurious substances, are required.

As needed, fluidizing gas can be introduced into the thick material under pressure such as air, water, steam and preselected chemicals.

The gaseous agent which is injected into the thick sludge fraction is introduced into the thick matter in the discharge region of the centrifuge exclusively. As a result of the introduction of the gaseous medium into the thick matter, not only does a pronouced loosening occur but the specific gravity ($g/cm^3$) of the thick matter is also considerably lowered due to the gas enclosed in the thick matter. The discharge of the thick matter above the level of the lightweight fraction is significantly facilitated particularly due to the lowering of the apparent density (specific gravity) of the thick matter. It is important as illustrated in the drawing, that the introduction of the gaseous medium occurs in the conical part of the centrifugal so that the worm member acts as a retarding disk and the lightweight fraction promotes the ejection of the thick matter as a consequence of its hydrostatic pressure.

It is also important that only thick matter is present in the region where the gas admission occurs since the lightweight phase would otherwise be undesirably discharged by the gas. The injection into the heavy phase creates a loosening that facilitates the heavy phase movement with the discharge worm. It is significant that this introduction occurs where a light phase is no longer present and the solids are thus loosened but no longer again permeated by the light phase. There is a coaction which occurs by the introduction exclusively into the heavy phase and by the introduction in the conical portion where the heavy phase is trapped and where the material is subjected to a diminishing cross-sectional area being moved forward in the cone. The flights of the tapered helix in the conical portion thus provide a conveyor for the heavy sludge which is subjected to the fluidizing action and also present a barrier preventing the material from escaping back to join the light phase which is discharged in the opposite axial direction.

Other advantages, features and objectives of the present invention will become more apparent with the teaching of the principles thereof in the disclosure of the features of the invention in the specification, claims and drawings, in which:

DESCRIPTION OF THE DRAWINGS

In the single FIGURE of the drawings, the FIG. is an axial section through a centrifugal worm separator constructed and operating in accordance with the principles of the present invention.

DESCRIPTION OF THE PREFERRED EMBODIMENTS

As shown on the drawing, a solid bowl worm centrifuge is constructed of a cylindrical drum jacket 1 including a jacket part 2 which is conically tapered toward one end which is designated as the thick phase material discharge end. The separator has a conveyor worm 3 which is coaxially arranged therein and arranged to be driven in rotation.

The conveyor worm 3 has a worm portion 4 which has a conical part 5. The worm member has on its outer surface a worm helix 6 with worm flights or vanes which have a reduced pitch or are at a closer distance to each other in the conical portion than in the basic worm helix portion 7. With this arrangement, the space between the worm flights in the conical part 5 of the conveyor will tend to fill with thick material or solids during operation of the centrifuge. The discharge of the thick or solid material from the centrifuge is facilitated and intensified with the injection and mixing within the drum of fluidizing agents.

In order to achieve this, the conical part of the conveyor worm can be constructed to be expanded toward the outside and the distance between the conical jacket part 5 of the conveyor worm and the conical drum jacket 2 of the centrifuge can be reduced in comparison to the cylindrical conveyor worm part and drum jacket part.

In the conical part are openings 8 which are in communication with conduits 9 and 10 that supply pressurized gas from outside the separator. The gas is supplied from an external lead as shown by the arrowed line on the righthand end of the drawing, through the conduit 10 to flow through the continuation conduit 9 and exit through the openings 8 located between the flights to be injected into the heavy phase material. The fluidizing gas also exits through the openings 18 which are passages formed in the flights extending to the outer edges of the flights. Thus, the fluidizing gas simultaneously enters and admixes with the heavy fraction both between the flights and at the edges of the flights. The location of the openings 8 and 18, as shown in the drawings, are located such that the gaseous agent enters exclusively into the heavy fraction at a point wherein the heavy fraction no longer has the opportunity to remix with the lighter fraction. In some instances, it may be desirable to inject the gaseous fluidizing agent only at the edges of the flights or only between the flights but in the preferred arrangement, the gaseous agent is injected at both locations. A significant feature is that the fluidizing gas is injected exclusively into the heavy sludge fraction at a point wherein the heavy fraction no longer has the opportunity to remix with the lighter fraction. As will be seen in the drawing, the centrifugal separator is provided with a tapered conical portion 2 and at that portion, the heavier sludge becomes concentrated and separated from the lighter fraction so that introduction of the gaseous fluidizing agent into the conical portion only will insure that it will not remix with the lighter fraction, and the fluidizing effect will be utilized by the heavier fraction.

The conduit 10 extends coaxially through the middle of a central pipe 11 that projects into the centrifuge drum and which delivers the liquid solid mixture to be separated as indicated by the arrow 12. The conduit 10 is rigidly connected to the worm member 4 and rotates with the conveyor worm during operation of the centrifuge. The conduit 10 is rotationally seated in the end wall 13 of the pipe 11.

The centrifuge is provided with a liquid opening 16 which extends in a radial direction from the separator. The heavy phase material flows out through an outlet as indicated by the port 17 radially from the separator.

During operation of the solid bowl worm centrifuge, a solids/liquid mixture is supplied to the pipe 11 in the direction of the arrow 12. This material to be separated flows into the cylindrical part 1 of the drum. As the worm is driven in rotation, a separation of the liquid occurs in accordance with the principles of centrifugal separation and the separated liquid flows as indicated by the arrow 14 as it is separated from the thick material and is conducted in a direction counter to the flow of the thick material which flows in the direction of the arrow 15. The light phase material then is discharged from the separator at the lefthand side of the drawing as indicated by the arrowed line 16. The thick material flows in the direction of the arrowed line 15 and is conveyed toward the right by the worm helix 7 toward the conical jacket portion 2. The heavy material there is conveyed by the worm helix 6 and is discharged from the separator through the ports 17. As the heavy phase material flows up the space defined by the conical portions, the fluidizing gas or other mixing agents is introduced and injected into the heavy phase from the openings 8 between the flights and the openings 18 at the outer edges of the flights. This fluidizing gas is introduced into the heavy phase between the worm pitches of the helix 6 and adjacent the outer surface of the heavy phase.

Dependent upon the material being handled, the injection of the fluidizing gas is preferably under pressure. A substantial dispersion of the thick material is thereby achieved and the discharge of the thick material is therefore effectively promoted. Since the worm pitches on the conical part 5 of the conveyor worm have smaller axial spacing from one another than the worm pitches of the worm helix 7 at the cylindrical part 4 of the conveyor, the space between the worm pitches in the conical part 5 of the worm is completed filled with thick sludge. As a result thereof, the discharge of the thick material often is impeded, but with the introduction of the fluidizing gas along the way, the discharge is substantially facilitated.

An injection of types of material to facilitate flow of the thick material from the centrifugal drum would include such gaseous agents as air, steam, hydrogen and the like.

This injection concept may be also utilized for the purpose of a treatment of the heavy phase material to accomplish neutralization or deodorizing and other effects. This can be accomplished by injection of the appropriate gas or substances in the gas through the openings 8 and 18. This injection will cause a preadmixing within the conical portion so that the nature of the exiting heavy phase material has been modified by the injection of the control substance.

Dependent on the nature of the material which is injected through the openings 8, and 18 the composition and viscosity of the heavy phase material can be substantially modified. The fluidizing gas or other modifying agent can be injected by being blown into the heavy phase material at a pressure which preferably is in the range between 0.5 and 5.0 bar. This accomplishes an adequate blending of the gas with the particles situated in the thick material. The concept of the arrangement is not limited to a solid bowl worm centrifuge but can be employed utilizing specific advantages in a solid bowl centrifuge of different design. Further, other chemical or physical reaction processes can be carried out by supplying appropriate fluid agents with the gas into the thick material. Suitable measures not only make it possible to supply fluidizing agent into the thick sludge but make it possible to modify the chemical nature of the sludge. The injection of appropriate agents can introduce a reaction process. While openings such as shown at 8 and 18 are preferred, sieve-like openings or other dispersed injection openings can be utilized to achieve the appropriate mixing.

Thus, it will be seen that we have provided an improved separation apparatus and method which meets the objectives and advantages above set forth.

We claim as our invention:

1. A method of separating material having heavy and light fractions in a centrifugal separator having an outlet for the light fractions and an outlet for the heavy fractions, the separator having a cylindrical drum rotatable about a horizontal axis with said outlet for the light fraction at a first end and said outlet for the heavy fraction at a second end and having a conical tapering part at the second end with a heavy fraction outlet conduit at the tapered end, a conveyor worm within the drum with worm helix flights at the outer surface and said flights having a conical part extending into the conical part of the drum, comprising the steps:

introducing gaseous agents into the heavy fraction within the separator only in a discharge area between the conical part of the conveyor worm and the conical part of the drum as the material is moving toward the centrifuge heavy fraction outlet, said gaseous agents fluidizing the heavy fraction and lowering its specific gravity and said gaseous agents moving axially between the flights and being discharged with the heavy fraction, the worm acting as a retarding disk for the heavy fraction so that hydraulic pressure of the light fraction promotes ejection of the heavy fraction, said gaseous agents being directed exclusively into the heavy fraction material at a pressure between 0.5 and 5.0 bar.

2. A method of separating material having light fractions and heavy fractions in a separator having an outlet for the light fractions and an outlet for the heavy fractions in accordance with the steps of claim 1:

including introducing the gaseous agents between the flights of the conveyor worm and at the edges of the flights.

3. A method of separating material having light fractions and heavy fractions in a separator having an outlet for the light fractions and an outlet for the heavy fractions in accordance with the steps of claim 1:

wherein the gaseous agents include a material chosen from the group of air, gas and stream,

4. A method of separating material having light fractions and heavy fractions in a separator having an outlet for the light fractions and an outlet for the heavy fractions in accordance with the steps of claim 1:

including introducing the gaseous agents between the flights of the conveyor worm.

5. A method of separating material having light fractions and heavy fractions in a separator having an outlet for the light fractions and an outlet for the heavy fractions in accordance with the steps of claim 1:

6. A solid bowl worm centrifuge for the separation of a liquid into a light fraction and a heavy fraction comprising in combination:

a cylindrical drum mounted for rotation on a horizontal axis having an outlet for the light fraction at a first end and an outlet for the heavy fraction at a second end and having a conical tapering part at the second end and with a heavy fraction outlet conduit at the tapered end;

a conveyor worm within the drum with worm helix flights at the outer surface and said flights having a conical part extending into the conical part of the drum;

a conduit having a plurality of openings disposed only between the conical part of said conveyor worm and the conical part of said drum for discharging fluidizing gaseous agents exclusively into the heavy fraction so that the specific gravity of the heavy fraction is lowered and the fluidizing agent and heavy fraction are moved together by the conical part of the flights;

a drum inlet for admission of a liquid to be separated and leading coaxially into the drum in a counterflow direction relative to a flow direction of the heavy fraction;

and means for delivering said fluidizing agents at a pressure between 0.5 and 5 bar into the conduit to flow between the flights, said fluidizing agents moved axially by the flights and flowing out of the drum with the heavy fraction through said heavy fraction outlet.

7. A solid bowl worm centrifuge and the separation of a liquid into a light fraction and a heavy fraction constructed in accordance with claim 6:

wherein said delivering means includes gas passages extending through the flights and having discharge openings at radial outer edges of the flights for discharge of the fluidizing agents adjacent an inner surface of the conical tapering part of the drum.

8. A solid bowl worm centrifuge for the separation of a liquid into a light fraction and a heavy fraction constructed in accordance with claim 6:

wherein said delivering means includes a gas passage with outlet openings between a plurality of flights in the conical part of the conveyor worm.

* * * * *